US006805102B2

(12) United States Patent
Schmidt et al.

(10) Patent No.: US 6,805,102 B2
(45) Date of Patent: Oct. 19, 2004

(54) METHOD OF INJECTING FUEL INTO THE COMBUSTION CHAMBERS OF AN INTERNAL COMBUSTION ENGINE, AND FUEL INJECTION SYSTEM FOR SAID ENGINE

(75) Inventors: Guenther Schmidt, Friedrichshafen (DE); Albert Kloos, Friedrichshafen (DE)

(73) Assignee: MTU Friedrichshafen GmbH, Friedrichshafen (DE)

( * ) Notice: Subject to any disclaimer, the term of this patent is extended or adjusted under 35 U.S.C. 154(b) by 0 days.

(21) Appl. No.: 10/472,139

(22) PCT Filed: Mar. 20, 2002

(86) PCT No.: PCT/EP02/03053

§ 371 (c)(1),
(2), (4) Date: Sep. 22, 2003

(87) PCT Pub. No.: WO02/077441

PCT Pub. Date: Oct. 3, 2002

(65) Prior Publication Data

US 2004/0112337 A1 Jun. 17, 2004

(30) Foreign Application Priority Data

Mar. 22, 2001 (DE) ..... 101 14 252

(51) Int. Cl.[7] ..... F02M 55/02
(52) U.S. Cl. ..... 123/467; 123/447
(58) Field of Search ..... 123/467, 447, 123/456, 468, 496, 500, 501

(56) References Cited

U.S. PATENT DOCUMENTS

| | | | | |
|---|---|---|---|---|
| 4,712,528 A | | 12/1987 | Schaffitz | 123/446 |
| 5,497,750 A | * | 3/1996 | Mueller et al. | 123/446 |
| 6,520,152 B1 | * | 2/2003 | Mahr et al. | 123/447 |
| 6,532,938 B1 | * | 3/2003 | Mahr et al. | 123/447 |
| 6,536,416 B1 | * | 3/2003 | Mahr et al. | 123/506 |

FOREIGN PATENT DOCUMENTS

| | | |
|---|---|---|
| DE | 43 41 543 | 6/1995 |
| DE | 43 44 190 | 6/1995 |
| DE | 197 12 135 | 8/1998 |
| EP | 0 657 642 | 6/1995 |
| EP | 1 030 052 | 8/2000 |

* cited by examiner

*Primary Examiner*—Weilun Lo
(74) *Attorney, Agent, or Firm*—Crowell & Moring LLP

(57) ABSTRACT

A method and a system are provided for injecting fuel into the combustion spaces of an internal-combustion engine, in which case the injection system contains a number of fuel injectors each comprising an injection valve and a common feed and storage line supplying the individual fuel injectors with highly pressurized fuel. The beginning and the end of the injection of the fuel into the combustion chamber are controlled by opening and closing the injection valve. A defined lowering of the fuel pressure existing in the fuel injector takes place during the injection, so that the pressure which rises because of the ram pressure during the closing of the injection valve at the end of the injection in the fuel injector does not exceed a defined value, particularly preferably the system pressure of the fuel injection system.

47 Claims, 2 Drawing Sheets

METHOD OF INJECTING FUEL INTO THE COMBUSTION CHAMBERS OF AN INTERNAL COMBUSTION ENGINE, AND FUEL INJECTION SYSTEM FOR SAID ENGINE

BACKGROUND AND SUMMARY OF THE INVENTION

The invention relates to a method of injecting fuel into the combustion chambers of an internal-combustion engine particularly a diesel engine, by means of a fuel injection system which contains a number of fuel injectors each comprising an injection valve and a common feed and storage line which supplies the individual fuel injectors by way of respective high-pressure lines with highly pressurized fuel and itself is acted upon by highly pressurized fuel by way of a high-pressure pump, the feeding of the fuel taking place from the storage line by way of one or more high-pressure reservoirs, and the beginning and end of the injection of the fuel into the combustion chambers being controlled by opening and closing the injection valves of the fuel injectors. The invention also relates to a fuel injection system for an internal-combustion engine according to particularly a diesel engine, which contains a number of fuel injectors each comprising an injection valve and a common feed and storage line which supplies the individual fuel injectors with highly pressurized fuel and itself is acted upon by highly pressurized fuel by way of a high-pressure pump, as well as one or more, particularly two high-pressure reservoirs which are, in each case, provided in the high-pressure lines leading to the fuel injectors and have a defined fuel storage volume, the beginning and end of the injection of the fuel into the combustion chambers being controlled by opening and closing the injection valves of the fuel injectors.

In the case of internal-combustion engines, particularly in the case of diesel engines, a type of fuel injection has increasingly been used in which a common feed and storage line (common rail) is acted upon by highly pressurized fuel by means of a high-pressure pump, and the highly pressurized fuel is fed by the latter by way of respective high-pressure lines to a number of fuel injectors which each comprise an injection valve. The beginning and the end of the injection of the fuel into the combustion chambers of the internal-combustion engine are controlled by the opening and closing of the injection valves provided in the fuel injectors. In addition, high-pressure reservoirs having a defined fuel storage volume may in each case be provided in the high-pressure lines leading to the fuel injectors. This type of a fuel injection is known, for example, from German Patent Document DE 197 12 135 C1.

The increasingly strict demands with respect to a limitation of pollutant emissions of internal-combustion engines have the tendency to require higher and higher injection pressures. The pressure which is maximally permissible in view of the stress on the material in a fuel injection system of the above-mentioned type is determined by the peak pressures occurring in the system. The highest pressure peaks occur in the fuel injector at the end of the injection. The cause is the so-called ram or surge pressure, which occurs during the closing of the injection valve and may be up to 400 bar above the system pressure. This means that conventionally the system pressure of the fuel injection system has had to be planned to be by up to the above-mentioned 400 bar lower than the peak pressure maximally acceptable with respect to the stress to the material.

The object of the invention is an improved method of injecting fuel into the combustion chambers of an internal-combustion engine as well as an improved fuel injection system for an internal-combustion engine.

The object is achieved by means of a fuel injection method limiting continued flow of the fuel during injection such that a defined lowering of fuel pressure existing in a fuel injector takes place from an initial pressure p1, which is slightly lower than a system pressure, to a second pressure p2 at a second point in time T2 when closing of a fuel injector valve starts, so that such pressure which rises because of ram pressure during the closing of the injection valve at the end of the injection in the fuel injector does not exceed a defined value. This object is also achieved by means of a fuel injection system wherein the fuel storage volume of the high-pressure reservoirs and the flow resistance of the high-pressure lines lead from the common feed and storage line to the high-pressure reservoirs, while taking into account the maximal injection quantity and duration, are dimensioned such, during the injection, a lowering of the fuel pressure existing in the fuel injector takes place from an initial pressure p1, which is slightly lower than the system pressure, to a fuel pressure p2 at a second point in time when the closing of the injection valve starts, so that the pressure, which rises as a result of the ram pressure during the closing of the injection valve at the end of the injection in the fuel injector, does not exceed a defined value.

The invention provides a method of injecting fuel into the combustion chambers of an internal-combustion engine, particularly a diesel engine, by means of a fuel injection system which contains a number of fuel injectors each comprising an injection valve and a common feed and storage line which supplies the individual fuel injectors by way of respective high-pressure lines with highly pressurized fuel and itself is acted upon by highly pressurized fuel by way of a high-pressure pump, the beginning and end of the injection of the fuel into the combustion chambers being controlled by opening and closing the injection valves of the fuel injectors. According to the invention, it is provided that, during the injection, a defined lowering of the fuel pressure existing in the fuel injector takes place, so that the pressure, which rises because of the ram pressure during the closing of the injection valve at the end of the injection in the fuel injector, does not exceed a defined value.

The defined lowering of the fuel pressure in the fuel injector preferably takes place to such a value that the pressure, which rises because of the ram pressure during the closing of the injection valve at the end of the injection in the fuel injector, does not exceed the fuel pressure, particularly the system pressure P0, existing in the fuel injector at the beginning of the injection.

According to an embodiment of the method according to the invention, it is provided that the feeding of the fuel from the common feed and storage line to the fuel injectors takes place by one or more, particularly two high-pressure reservoirs provided in the high-pressure lines leading to the fuel injectors and having a defined fuel storage volume, and that the defined lowering of the fuel pressure existing in the fuel injector takes place by limiting the continued flow of the fuel in the high-pressure lines leading from the common feed and storage lines to the high-pressure reservoirs.

When two high-pressure reservoirs are used, the high-pressure reservoir situated closer to the injector is preferably constructed with a smaller volume than the high-pressure reservoir situated farther upstream. A quantity-limiting valve, which is preferably situated downstream of the respective high-pressure reservoir, is assigned to at least one high-pressure reservoir.

According to an embodiment of the method according to the invention, the limiting of the continued flow of the fuel takes place by throttling points provided in the high-pressure lines leading from the common feed and storage line to the higher-pressure reservoirs.

According to another embodiment, the limiting of the continued flow of the fuel takes place by dimensioning the diameter D2 of the high-pressure lines leading from the common feed and storage line to the high-pressure reservoirs.

It is an advantage of the injection method according to the invention that a high injection pressure can be used at the beginning of the injection without causing an unacceptable overstressing of the material in the fuel injector.

Furthermore, by means of the invention, a fuel injection system for an internal-combustion engine, particularly a diesel engine, is created which contains a number of fuel injectors each comprising an injection valve and a common feed and storage line which supplies the individual fuel injectors by way of respective high-pressure lines with highly pressurized fuel and itself is acted upon by highly pressurized fuel by way of a high-pressure pump, as well as, in each case, one or more, particularly two high-pressure reservoirs which are provided in the high-pressure lines leading to the fuel injectors and have a defined fuel storage volume, the beginning and end of the injection of the fuel into the combustion chambers being controlled by opening and closing the injection valves of the fuel injectors. According to the invention, it is provided that the fuel storage volume of the high-pressure reservoirs and the flow resistance of the high-pressure lines leading from the common feed and storage line to the individual high-pressure reservoirs, while taking into account the maximal injection quantity and duration, are dimensioned such that the pressure, which rises as a result of the ram pressure during the closing of the injection valve at the end of the injection in the fuel injector, does not exceed a defined value.

The fuel storage volume of the high-pressure reservoirs and the flow resistance of the high-pressure lines leading to the high-pressure reservoirs are preferably dimensioned such that the pressure rising as a result of the ram pressure during the closing of the injection valve at the end of the injection in the fuel injector does not exceed the fuel pressure, particularly the system pressure P0, existing at the beginning of the injection in the fuel injector.

According to an embodiment of the fuel injection system according to the invention, it is provided that the flow resistance of the high-pressure lines leading from the common feed and storage line to the high-pressure reservoirs is determined by throttling points.

According to another embodiment of the invention, it is provided that the flow resistance of the high-pressure lines leading from the common feed and storage line to the high-pressure reservoirs is determined by their diameter D2.

As in the case of the fuel injection method according to the invention, it is also an important advantage of the fuel injection system according to the invention that high pressures can be used at the beginning of the injection without causing an unacceptable overstressing of material in the fuel injectors.

For a fuel injection without the lowering of the fuel pressure existing in the fuel injector toward the end of the injection according to the invention, if equally high initial pressures are to be achieved, the fuel injectors would have to be designed for the significantly higher pressures which arise because of the ram or surge pressures occurring during the closing of the injection valve.

In the following, an embodiment of the invention will be explained by means of the drawing.

DETAILED DESCRIPTION OF THE DRAWINGS.

Figure 1:
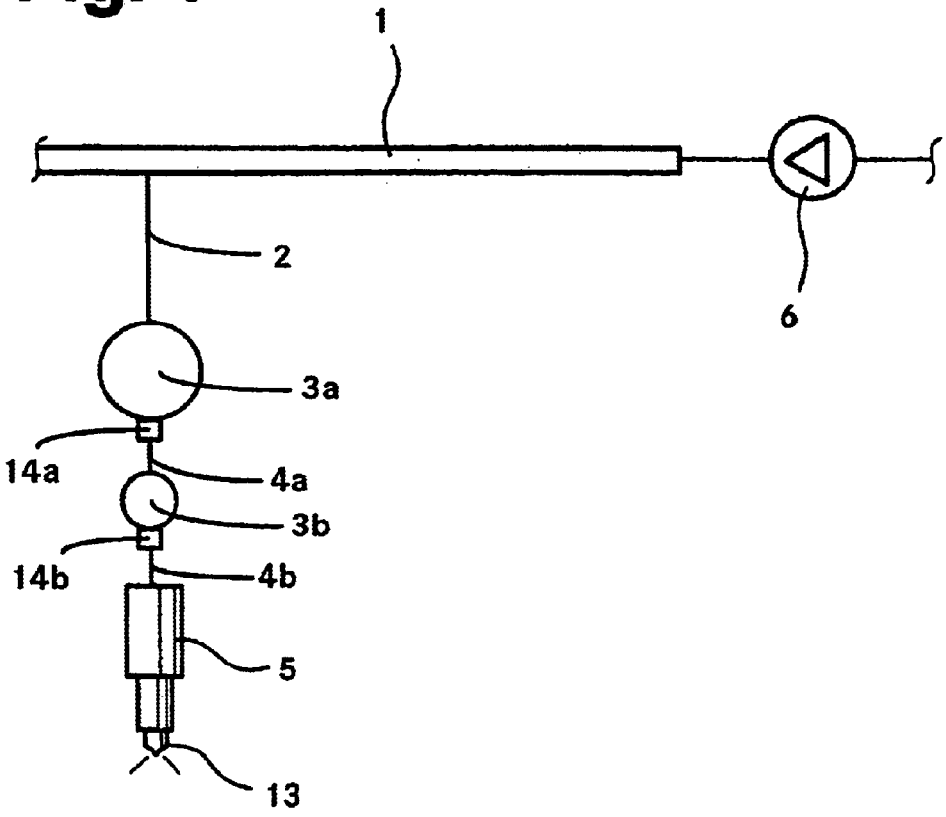
FIG. 1 is a schematic block diagram of a section of the fuel injection system according to an embodiment of the invention.

In the section of a fuel injection system illustrated in FIG. 1, reference number 5 indicates one of typically several fuel injectors for injecting fuel into the combustion chambers of an internal-combustion engine, particularly a diesel engine. By means of a control unit not illustrated in FIG. 1, the fuel injectors 5 are controlled such that a fuel quantity is injected which is optimally adapted to the rotational speed and the load condition of the internal-combustion engine. From a fuel supply, which is also not shown in FIG. 1, the fuel is fed under a high pressure by means of one or more high-pressure pumps 6 first to a common feed and storage line 1, from which high-pressure lines 2, 4*a*, 4*b* branch off which are used for supplying the individual fuel injectors 5.

One or more high-pressure reservoirs 3*a*, 3*b* are provided in the high-pressure lines 2, 4*a*, 4*b* leading to the fuel injectors 5. The section of the high-pressure line leading from the common feed and storage line 1 to the high-pressure reservoir 3*a* is marked by reference number 2, whereas the sections of the high-pressure line leading from the high-pressure reservoirs 3*a*, 3*b* to the fuel injector 5 have the reference numbers 4*a* and 4*b*. Quantity-limiting valves 14*a* and 14*b* are assigned to the high-pressure reservoirs 3*a* and 3*b*, which quantity-limiting valves 14*a* and 14*b* are preferably situated downstream of the high-pressure reservoirs 3*a*, 3*b* but may also be situated upstream.

The high-pressure reservoirs 3*a*, 3*b* act as oil-elastic reservoirs in whose fuel storage volume fuel, which is acted upon by high pressure supplied by the common feed and storage line 6, is stored for the feeding to the fuel injectors 5.

The common feed and storage line 1 also typically has the function of an oil-elastic reservoir in which the fuel, which is acted upon by the high pressure supplied by the high-pressure pump 6, is stored for the further distribution to the high-pressure reservoirs 3*a*, 3*b* by way of the high-pressure lines 2, 4*a*, 4*b*.

Figure 2:
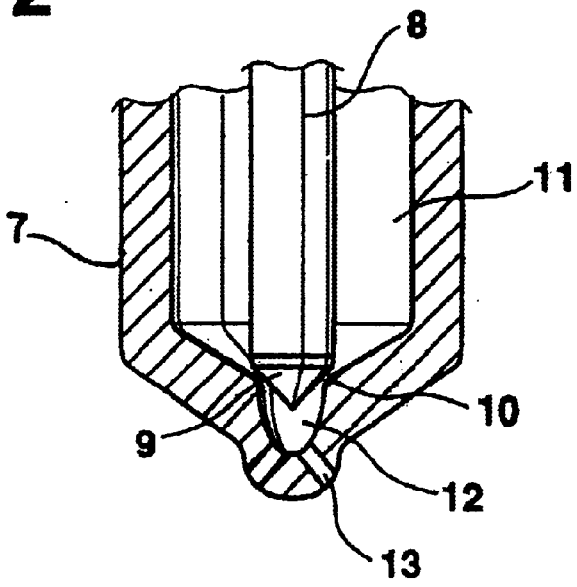
FIG. 2 is a schematic cross-sectional view of the section of a fuel injector comprising the injection valve.

The cross-sectional view shown in FIG. 2 shows a section of the injector housing 7 of the fuel injector 5 which projects into the combustion chamber of the internal-combustion engine and contains an injection nozzle 13 by way of which fuel is injected into the combustion chamber. In this section of the injector housing 7, an injection valve is constructed which is formed by the point 9 of a nozzle needle 8 longitudinally displaceably disposed in a known manner in the fuel injector 5 and by a nozzle needle seat 10 interacting with the nozzle needle point 9. During the opening of the injection valve 9, 10, fuel situated in an antechamber 11 and supplied under high pressure by way of the high-pressure line 4*a*, 4*b* into the fuel injector is released for the injection by way of the injection nozzle 13. A blind hole 12, from which the injection nozzle 13 branches off, is situated in front of the nozzle needle point 9.

The opening and closing of the injection valve 9, 10 and thus the beginning and the end of the injection of the fuel into the combustion chamber of the internal-combustion engine are controlled by the above-mentioned control unit.

Figure 3:
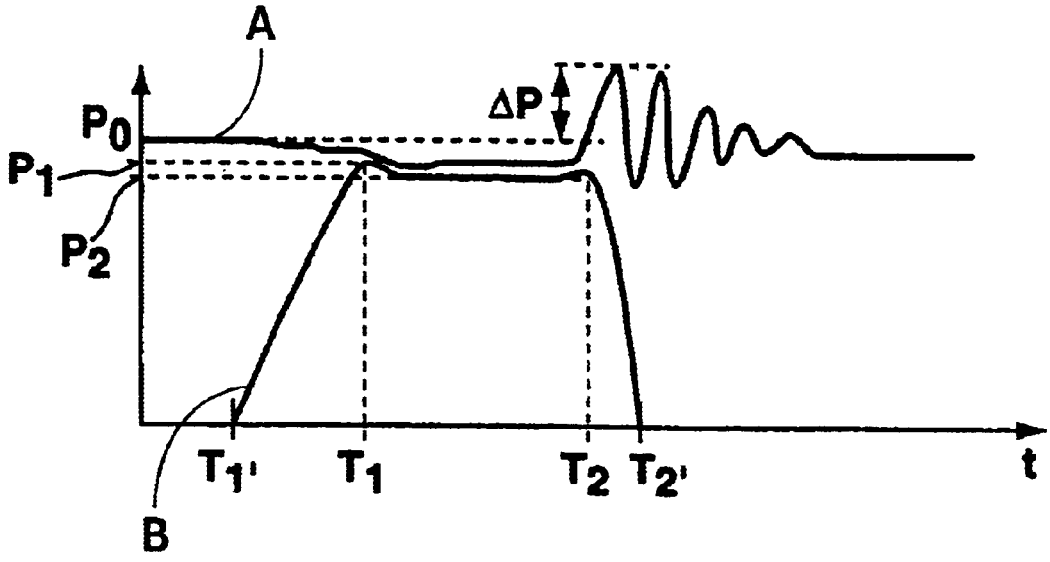
Fig. 3 PRIOR ART
FIG. 3 is a diagram of the pressure conditions for a conventional fuel injection existing in the fuel injector during an injection operation.

The diagram illustrated in FIG. 3 shows the pressure conditions entered in comparison to the time in the case of a conventional injection of fuel into the combustion chamber of an internal-combustion engine. The curve marked A shows the fuel pressure existing in the antechamber 11 in front of the injection valve 9, 10, which fuel pressure is equal to the system pressure P0 when the injection valve is closed; the curve marked B indicates the pressure in the blind hole 12 during the injection operation. The beginning of the injection operation, when the injection valve 9, 10 starts to open, is marked T1'; the end of the injection operation, when the injection valve 9, 10 starts to close, is marked T2. As indicated by the curve B, at the beginning of the injection, the pressure in the blind hole 12 rises relatively rapidly from the 0 pressure at the point in time T1' to the P1 value at the point in time T1, which is almost identical to the system pressure existing in the antechamber 11. At the point in time T1, the fuel pressure existing in the antechamber 11 has slightly fallen with respect to the system pressure P0 because of the fuel removal. During the time period from T1 to T2, thus while the injection valve 9, 10 is open, the pressure in the blind hole 12 corresponds essentially to the pressure in the antechamber 11. During the closing of the injection valve 9, 10, the pressure in the blind hole 12 falls starting from the point in time T2, where the pressure essentially still corresponds to the pressure in the antechamber 11, to the 0 pressure at the point in time T2', at this point in time, the injection valve 9, 10 being completely closed, thus the nozzle needle point 9 fitting closely into the nozzle needle seat 10.

As a result of the ram or surge pressure occurring during the closing of the injection valve 9, 10, a rapid pressure rise takes place in the antechamber 11 which may be by up to 400 bar above the system pressure. As indicated by the curve A in FIG. 3, this pressure peak, with several fluctuations, will subside again by the point in time T3. As explained at the beginning, these pressure peaks occurring during the closing of the injection valve 9, 10 represent significant stress for the fuel injector 5.

Figure 4:
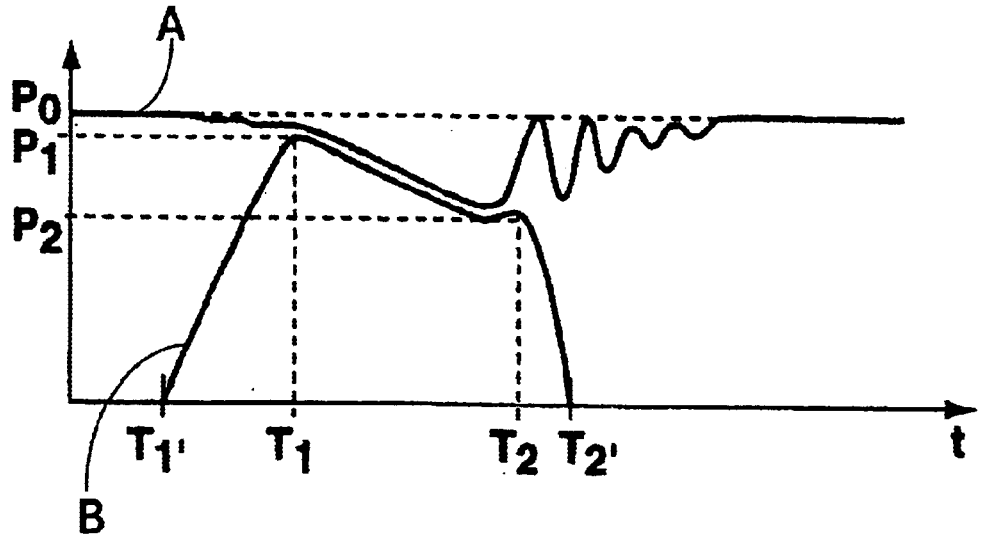
FIG. 4 is a diagram of the pressure conditions according to an embodiment of the invention existing in the fuel injector during the injection operation.

FIG. 4 is a corresponding diagram in which the pressure conditions existing in the fuel injector 5 are illustrated as a function of the time, as they occur in the case of the fuel injection method according to the invention and the fuel injection system according to the invention respectively. In FIG. 4, the pressure existing in the blind hole 12 of the fuel injector 5 is again indicated by the curve B; the curve A shows the pressure existing in the antechamber 11. The system pressure, which is virtually completely present in the antechamber 11 when the injection valve 9, 10 is closed, is marked P0. During the opening of the injection valve 9, 10, thus also during the releasing of the nozzle needle point 9 from the nozzle needle seat 10 at the point in time T1', a rapid rise of the fuel pressure existing in the blind hole 12 of the fuel injector 5 starts until this fuel pressure, at the point of time T1, virtually reaches the fuel pressure existing in the antechamber 11. At the point in time T1, the latter has slightly fallen with respect to the system pressure P0 as a result of the fuel removal.

According to the invention, a defined lowering of the fuel pressure existing in the antechamber 11 of the fuel injector 5 during the injection takes place from the initial pressure P1 at the point in time T1, to the fuel pressure P2 at the point in time T2 when the closing of the injection valve 9, 10 starts. The fuel pressure P2 at the point in time T2 has such a lowered value that the pressure which rises at the end of the injection because of the ram pressure during the closing of the injection valve 9, 10 does not exceed a defined value. In the embodiment illustrated in FIG. 4, the above-mentioned defined lowering of the fuel pressure takes place to such a value that the pressure which rises because of the ram pressure during the closing of the injection valve 9, 10 does not exceed the fuel pressure, particularly the system pressure P0, existing at the beginning of the injection in the fuel injector 5.

Returning to the embodiment of the fuel injection system according to the invention illustrated in FIG. 1, the fuel reservoir volumes of the high-pressure reservoirs 3*a*, 3*b* and the flow resistance of the high-pressure line 2 leading from the common feed and storage line 1 to this high-pressure reservoir 3*a*, 3*b*, while taking into account the maximal injection quantity and duration, are dimensioned such that the pressure drop occurs which is illustrated in FIG. 4. Specifically, the pressure drop is caused in that the fuel can continue to flow less fast by way of the high-pressure line 2 to the high-pressure reservoirs 3*a*, 3*b* and to the fuel injector 5 than it is injected by way of the injection nozzle —compare FIG. 2—into the combustion chamber of the internal-combustion engine. This limitation of the continued flow of the fuel may take place by means of a throttling point which is provided in the high-pressure line 2 leading from the common feed and storage line 1 to the high-pressure reservoir 3*a*, or, which is preferable, by means of a dimensioning of the diameter D2 (inside diameter) and of the length of the high-pressure line 2 leading from the common feed and storage line 1 to the high-pressure reservoir 3*a*. The throttling point or the line cross-section and the high-pressure reservoir volumes are naturally adapted to the highest stressing possibility, specifically when the internal-combustion engine is running at full load. So that the required injection quantity can be injected during the available time period, the rail pressure (system pressure) should then be selected to be the highest. At a partial load, the fuel pressure in the feed and storage line 1 is reduced. Because of the limited continued fuel flow, however, a lowering of the pressure in the antechamber 11 according to curve A of FIG. 4 can also be observed at a partial load.

Instead of two high-pressure reservoirs 3*a*, 3*b* illustrated in FIG. 1, only one high-pressure reservoir may be used. When two high-pressure reservoirs are used, preferably the high-pressure reservoir 3*b* situated closer to the injector and, if possible, integrated in the injector will, for space reasons, be constructed with a smaller volume than the high-pressure reservoir 3*a* situated farther away upstream.

Because of the short distance from the nozzle holes, the smaller second high-pressure reservoir 3*b* mainly has a damping function. Because of the short connection, a rapid pressure compensation can be caused as a result of the rapid continued flow of fuel from the high-pressure reservoir 3*b* in front of the nozzle holes 13, which reduces the amplitude of the surge. The lines 4*a* and 4*b* are constructed with a large cross-section in order to ensure an unhindered continued fuel flow.

The quantity-limiting valves 14*a*, 14*b* are mainly used to prevent the continued flow of fuel and a continuous injection in the event of a jamming of the needle. However, they have an additional damping function which is caused by the displaceable piston and the flow ducts formed in the valve. The quantity-limiting valves have a favorable effect on the subsiding action of the pressure fluctuation at the injection end. For an optimal function, the quantity-limiting valves should advantageously be mounted downstream at the output of at least the larger high-pressure reservoir 3*a*.

| List of Reference Numbers | |
|---|---|
| 1 | Common feed and storage line |
| 2 | high-pressure line |
| 3a, 3b | high-pressure reservoir |
| 4a, 4b | high-pressure line |
| 5 | fuel injector |
| 6 | high-pressure pump |
| 7 | injector housing |
| 8 | nozzle needle |
| 9 | nozzle needle point |
| 10 | nozzle needle seat |
| 11 | antechamber |
| 12 | blind hole |
| 13 | injection nozzle |
| 14a, 14b | quantity-limiting valve |

What is claimed is:

1. Method of injecting fuel into the combustion chambers of an internal-combustion engine, including a diesel engine, by means of a fuel injection system which contains a number of fuel injectors each comprising an injection valve and a common feed and storage line which supplies the individual fuel injectors by way of respective high-pressure lines with highly pressurized fuel and itself is acted upon by highly pressurized fuel by way of a high-pressure pump, the feeding of the fuel taking place from the storage line by way of one or more high-pressure reservoirs, and the beginning and end of the injection of the fuel into the combustion chambers being controlled by opening and closing the injection valves of the fuel injectors, said method comprising:

limiting continued flow of the fuel during injection, such that a defined lowering of the fuel pressure existing in a fuel injector takes place from an initial pressure p1, which is slightly lower than a system pressure, to a second pressure p2 at a second point in time T2 when closing of a fuel injection valve starts, so that such pressure which rises because of ram pressure during the closing of the injection valve at the end of the injection in the fuel injector does not exceed a defined value.

2. Method according to claim 1, wherein the defined lowering of the fuel pressure in the fuel injector takes place such that the pressure which rises because of the ram pressure during the closing of the injection valve at the end of the injection in the fuel injector, does not exceed the system pressure existing in the fuel injector at the beginning of the injection.

3. Method according to claim 1, wherein feeding of the fuel from the common feed and storage line to the fuel injectors is through two high-pressure reservoirs provided in each of the high-pressure lines leading to the fuel injectors and having a defined fuel storage volume, and wherein the defined lowering of the fuel pressure existing in the fuel injector takes place by limiting the continued flow of the fuel in the high-pressure lines leading from the common feed and storage line to the high-pressure reservoirs.

4. Method according to claim 2, wherein feeding of the fuel from the common feed and storage line to the fuel injectors is through two high-pressure reservoirs provided in each of the high-pressure lines leading to the fuel injectors and having a defined fuel storage volume, and wherein the defined lowering of the fuel pressure existing in the fuel injector takes place by limiting the continued flow of the fuel in the high-pressure lines leading from the common feed and storage line to the high-pressure reservoirs.

5. Method according to claim 1, wherein feeding of the fuel from the common feed and storage line is through at least one high pressure reservoir provided in each respective high-pressure line leading to the respective fuel injector and having a defined storage volume, and wherein the defined lowering of the fuel pressure existing in the fuel injector takes place by limiting the continued flow of the fuel in the high-pressure lines leading from the common feed and storage line to the respective at least one high-pressure reservoir.

6. Method according to claim 3, wherein the high-pressure reservoir situated closer to the injector has a smaller volume than the high-pressure reservoir situated farther upstream.

7. Method according to claim 4, wherein the high-pressure reservoir situated closer to the injector has a smaller volume than the high-pressure reservoir situated farther upstream.

8. Method according to claim 3, wherein a quantity-limiting valve is assigned to at least one of the high-pressure reservoirs, which quantity-limiting valve is in each case situated downstream of the high-pressure reservoir.

9. Method according to claim 4, wherein a quantity-limiting valve is assigned to at least one of the high-pressure reservoirs, which quantity-limiting valve is in each case situated downstream of the high-pressure reservoir.

10. Method according to claim 5, wherein a quantity limiting valve is disposed downstream of each of said at least one high-pressure reservoirs.

11. Method according to claim 3, wherein the limiting of the continued flow of the fuel takes place by means of throttling points provided in the high-pressure lines leading from the common feed and storage line to the high-pressure reservoirs.

12. Method according to claim 4, wherein the limiting of the continued flow of the fuel takes place by means of throttling points provided in the high-pressure lines leading from the common feed and storage line to the high-pressure reservoirs.

13. Method according to claim 5, wherein the limiting of the continued flow of the fuel takes place by means of throttling points provided in the high-pressure lines leading from the common feed and storage line to each of the at least one high-pressure reservoirs.

14. Method according to claim 6, wherein the limiting of the continued flow of the fuel takes place by means of throttling points provided in the high-pressure lines leading from the common feed and storage line to the high-pressure reservoirs.

15. Method according to claim 8, wherein the limiting of the continued flow of the fuel takes place by means of throttling points provided in the high-pressure lines leading from the common feed and storage line to the high-pressure reservoirs.

16. Method according to claim 3, wherein the limiting of the continued flow of the fuel takes place by the dimensioning of the diameter of the high-pressure lines leading from the common feed and storage line to the high-pressure reservoirs.

17. Method according to claim 4, wherein the limiting of the continued flow of the fuel takes place by the dimensioning of the diameter of the high-pressure lines leading from the common feed and storage line to the high-pressure reservoirs.

18. Method according to claim 5, wherein the limiting of the continued flow of the fuel takes place by the dimensioning of the diameter of the high-pressure lines leading from the common feed and storage line to each of the at least one high-pressure reservoirs.

19. Method according to claim 6, wherein the limiting of the continued flow of the fuel takes place by the dimensioning of the diameter of the high-pressure lines leading from the common feed and storage line to the high-pressure reservoirs.

20. Method according to claim 11, wherein the limiting of the continued flow of the fuel takes place by the dimensioning of the diameter of the high-pressure lines leading from the common feed and storage line to the high-pressure reservoirs.

21. Fuel injection system for an internal-combustion engine, including a diesel engine, which contains a number of fuel injectors each comprising an injection valve and a common feed and storage line which supplies the individual fuel injectors with highly pressurized fuel and itself is acted upon by highly pressurized fuel by way of a high-pressure pump, as well as two high-pressure reservoirs which are, in each case, provided in the high-pressure lines leading to the fuel injectors and have a defined fuel storage volume, the beginning and end of the injection of the fuel into the combustion chambers being controlled by opening and closing the injection valves of the fuel injectors, wherein the fuel storage volume of the high-pressure reservoirs and the flow resistance of the high-pressure lines leading from the common feed and storage line to the high-pressure reservoirs, while taking into account the maximal injection quantity and duration, are dimensioned such that, during the injection, a lowering of the fuel pressure existing in the fuel injector takes place from an initial pressure p1, which is slightly lower than the system pressure, to a fuel pressure p2 at a second point in time when the closing of the injection valve starts, so that the pressure, which rises as a result of the ram pressure during the closing of the injection valve at the end of the injection in the fuel injector, does not exceed a defined value.

22. Fuel injection system according to claim 21, wherein the fuel storage volume of the high-pressure reservoirs and the flow resistance of the high-pressure line leading from the common feed and storage line to the high-pressure reservoirs is dimensioned such that the pressure which rises because of the ram pressure during the closing of the injection valve at the end of the injection in the fuel injector does not exceed the system pressure P0 existing at the beginning of the injection in the fuel injector.

23. Fuel injection system according to claim 21, wherein in the case of an arrangement with, in each case, two high-pressure reservoirs, the high-pressure reservoir situated closer to the injector has a smaller volume than the second high-pressure reservoir situated upstream.

24. Fuel injection system according to claim 22, wherein in the case of an arrangement with, in each case, two high-pressure reservoirs, the high-pressure reservoir situated closer to the injector has a smaller volume than the second high-pressure reservoir situated upstream.

25. Fuel injection system according to claim 21, wherein a quantity-limiting valve is assigned to at least one of the high-pressure reservoirs, which quantity-limiting valve is in each case situated downstream of the respective high-pressure reservoir.

26. Fuel injection system according to claim 22, wherein a quantity-limiting valve is assigned to at least one of the high-pressure reservoirs, which quantity-limiting valve is in each case situated downstream of the respective high-pressure reservoir.

27. Fuel injection system according to claim 23, wherein a quantity-limiting valve is assigned to at least one of the high-pressure reservoirs, which quantity-limiting valve is in each case situated downstream of the respective high-pressure reservoir.

28. Fuel injection system according to claim 21, wherein the flow resistance of the high-pressure lines leading from the common feed and storage line to the high-pressure reservoirs is determined by throttling points.

29. Fuel injection system according to claim 22, wherein the flow resistance of the high-pressure lines leading from the common feed and storage line to the high-pressure reservoirs is determined by throttling points.

30. Fuel injection system according to claim 23, wherein the flow resistance of the high-pressure lines leading from the common feed and storage line to the high-pressure reservoirs is determined by throttling points.

31. Fuel injection system according to claim 25, wherein the flow resistance of the high-pressure lines leading from the common feed and storage line to the high-pressure reservoirs is determined by throttling points.

32. Fuel injection system according to claim 21, wherein the flow resistance of the high-pressure lines leading from the common feed and storage line to the high-pressure reservoirs is determined by their diameter.

33. Fuel injection system according to claim 22, wherein the flow resistance of the high-pressure lines leading from the common feed and storage line to the high-pressure reservoirs is determined by their diameter.

34. Fuel injection system according to claim 23, wherein the flow resistance of the high-pressure lines leading from the common feed and storage line to the high-pressure reservoirs is determined by their diameter.

35. Fuel injection system according to claim 25, wherein the flow resistance of the high-pressure lines leading from the common feed and storage line to the high-pressure reservoirs is determined by their diameter.

36. A fuel injection system assembly for an internal combustion engine comprising:

a plurality of fuel injection valves, a common feed line operable to supply highly pressurized fuel at a system pressure, and high pressure lines leading from the common feed line to respective ones of the fuel injection valves, wherein the fuel storage volume and flow resistance of the system intermediate the common feed line and the fuel injection valves are configured such that, during injection, a lowering of the fuel pressure in the fuel injector from an initial pressure which is slightly lower than the system pressure to a second fuel pressure at a later point in time when closing of the injector valve starts, such that the injector valve pressure which rises as a result of ram pressure during the closing of the injection valve at the end of injection does not exceed a predetermined value.

37. A fuel injection system assembly according claim 36, wherein said predetermined value does not exceed the system pressure existing at initiation of injection in the fuel injector.

38. A fuel injection system assembly according to claim 36, wherein the system intermediate the feed line and respective fuel injection valves includes high pressure reservoir means.

39. A fuel injection system assembly according to claim 38, wherein the high pressure reservoir means includes two high pressure reservoirs in series in each high pressure line leading to a respective fuel injection valve.

40. A fuel injection system assembly according to claim 39, wherein the high pressure reservoirs have different volumes with the one closest to the injection valve having a smaller volume than the one upstream thereof.

41. A fuel injection system assembly according to claim 40, comprising quantity limiting valves in the high pressure lines.

42. A method of supplying fuel to an internal combustion engine using a fuel injection system assembly comprising:

a plurality of fuel injection valves, a common feed line operable to supply highly pressurized fuel at a system pressure, and high pressure lines leading from the common feed line to respective ones of the fuel injection valves, said method comprising controlling the fuel pressure at the injection valves such that during injection, a lowering of the fuel pressure in the fuel injector from an initial pressure which is slightly lower than the system pressure to a second fuel pressure at a later point in time when closing of the injector valve starts, such that the injector valve pressure which rises as a result of ram pressure during the closing of the injection valve at the end of injection does not exceed a predetermined value.

43. A method according to claim 42, wherein said predetermined value does not exceed the system pressure existing at initiation of injection in the fuel injector.

44. A method according to claim 42, wherein the system intermediate the feed line and respective fuel injection valves includes high pressure reservoir means.

45. A method according to claim 44, wherein the high pressure reservoir means includes two high pressure reservoirs in series in each high pressure line leading to a respective fuel injection valve.

46. A method according to claim 45, wherein the high pressure reservoirs have different volumes with the one closest to the injection valve having a smaller volume than the one upstream thereof.

47. A method according to claim 46, comprising quantity limiting valves in the high pressure lines.

* * * * *